United States Patent [19]

Craven

[11] 4,091,950

[45] May 30, 1978

[54] HINGED BIN

[75] Inventor: Daniel R. Craven, Orinda, Calif.

[73] Assignee: Pennsylvania Pacific Corporation, Warminster, Pa.

[21] Appl. No.: 822,558

[22] Filed: Aug. 8, 1977

[51] Int. Cl.[2] ..... B65D 7/24; B65D 9/18

[52] U.S. Cl. ..... 217/47; 217/15; 220/6; 220/1.5

[58] Field of Search ..... 217/12, 15, 43, 47; 220/6, 1.5, 73

[56] References Cited

U.S. PATENT DOCUMENTS

| | | | |
|---|---|---|---|
| 524,259 | 8/1894 | Matthews | 217/47 |
| 669,631 | 3/1901 | Gillette | 217/47 |
| 1,216,210 | 2/1917 | Campbell | 217/47 |
| 3,139,205 | 6/1964 | Haubrich | 217/47 |

*Primary Examiner*—William Price
*Assistant Examiner*—Steven M. Pollard
*Attorney, Agent, or Firm*—Smith, Harding, Earley & Follmer

[57] ABSTRACT

A hinged knock-down returnable, self-locking bin includes a base panel, first and second side panels, first and second end panels, and first and second panel hinge means, the first panel hinge means being provided for hingedly connecting each of the side panels to a side of the base panel, and the second hinged means being provided for hingedly connecting each of the end panels to an end of the base panel. Locking meansare provided for connecting the tops of the side panels to the tops of the end panels. The bin is characterized by its simplicity of structure, the ease with which it may be erected for use in shipment, singly or in stacked interlocking relation, and the ease with which it may be collapsed so as to occupy a minimum space for storage and return shipment for further use when emptied of its contents. Further features of the bin are its provisions for stacking while minimizing the load placed upon the side and end walls of the lower bins, and the freedom from the possibility of loss of panel members when the bin is collapsed or knocked-down for storage or return shipment.

12 Claims, 9 Drawing Figures

HINGED BIN

BACKGROUND OF THE INVENTION

1. Field of the Invention

This invention relates to prefabricated open topped containers or bins, and more particularly, to unitary bin assemblies that are collapsible for conserving storage space and that are suitable when opened up or erected for stacking one upon another in an interlocking manner.

2. Description of the Prior Art

Prefabricated knock-down completely closed container or box assemblies that may be stacked one upon another in an interlocking manner are known in the prior art. Examples of such box assemblies which have been made and sold commercially for many years are shown in U.S. Pat. No. 2,710,703 that was granted to J. W. Kephart, Jr., on June 14, 1955. Each of the prior art box assemblies shown in the Kephart patent is formed of six panel members comprising a base panel, two side panels, two end panels, and a top panel. A closing slat is also provided. The various panels have appropriately attached cleats for supporting and holding the assembled box together. The several panels with their attached cleats and the closing slat are factory built and supplied to packers in knock-down form. This has provided a substantial reduction not only in the cost of manufacture but also in the cost of shipping and storage. The knock-down box assembly may be repeatedly assembled and disassembled. After each of a shipment of such box assemblies has been emptied of its contents, each such box assembly may be disassembled to reduce the space required for storage and for return shipment to the packer for reuse. While this is effective in reducing the storage and shipping space required for the disassembled boxes, there is a problem however, caused by the large number of panel and slat members that are involved, particularly when it is desired to store or ship the number of boxes ordinarily involved in commercial and industrial usage. This has caused serious difficulties for packers not only in respect of having to replace lost panel or slat members, but also in having to sort out, from the numerous separate panel and slat members that are returned, that combination of base, side, top panel and slat members required for a box assembly.

SUMMARY OF THE INVENTION

Among the object of the present invention is the provision of a prefabricated, strong, rigid, open topped, knock-down returnable, self-locking collapsible bin that may be erected for holding articles and that may be collapsed when emptied of the articles for storing and/or for returning the empty bin to a packer for the further shipment of articles.

Another object of the invention is to provide such a collapsible bin having five panel members including a base panel, two side panels, and two end panels and wherein the side and end panels are hinged to the base panel so that none of the panel members can become mislaid or lost when the bin is in a collapsed or knocked-down state for storage or return shipment to the packer.

A further object of the invention is the provision of such a collapsible bin wherein the hinged members and the means for locking the bin in its erected state are disposed externally of the bin whereby the hinges and locking means are precluded from damaging the contents of the bin, which in some commercial applications, for example, may comprise apples or other fruits or other products which would tend to be scarred by the hinges or locking means if the latter were mounted inside the bin.

In accomplishing these and other objects there is provided according to a first embodiment of the present invention a bin assembly comprising a base panel, first and second side panels, and first and second end panels. The base panel includes a deckboard with runners mounted on the bottom and depending therefrom. Base panel cleats are mounted on the upper surface of the base panel deckboard at the ends of the deckboard for locking the end and side panels against endwise movement.

Each of the side panels includes a side panel sheet. A side panel bottom cleat is mounted on the outer surface of the bottom portion of each of the side panel sheets. The side panel bottom cleats are shorter than the width of the side panel sheets. A side panel top cleat is mounted on the top and outer surface top portion of each of the side panel sheets. The ends of each of said side panel top cleats are flush with the side edges of the associated side panel sheets. Desirably, each side panel top cleat is bevelled on each of its outer side and top edges.

Each of the end panels includes an end panel sheet. An end panel top cleat is mounted on the top and outer surface of each of the end panel sheets, the ends of the end panel top cleats being flush with the side edges of the end panel sheets. A pair of end panel upright posts or stacking cleats may be mounted on the outer surface of the end panel sheets. The top ends of the end panel stacking cleats abut the lower edge of the associated end panel top cleat and the bottom ends of the end panel stacking cleats are recessed from the bottom of the end panel sheets by a distance equal to the height of the base panel cleats. A pair of upright end panel cleats are mounted on the inner surface of each of the end panel sheets flush with the side edges of the end panels.

Hinge means of the double leaf type are provided for hingedly connecting each of the side panels to the deckboard of the bottom panel. Hinge means of the pivot bearing type are provided for hingedly connecting the end panels to the deckboard of the bottom panel. Locking means are provided for connecting the tops of side panels to the tops of end panels.

In a second embodiment of the invention the base panel cleats on the upper surface of the base panel deckboard are omitted and instead each of the end panels has a bottom as well as a top cleat mounted on the outer surface of the associated end panel sheet, with the ends of the top and bottom cleats being flush with the side edges of the end panel sheets. This facilitates manufacture and avoids a problem attendant shrinking of the deckboard when base panel cleats are mounted on the upper surface of the base panel deckboard.

The ends of the base panel runners in each embodiment may be notched to provide vertical shoulders that are adapted to contact the end panel top cleats of a lower bin, when the bins are stacked, thereby to prevent endwise sliding between stacked bins. Notches may also be provided intermediate the ends of the base panel runners to allow forklift loading of the bin.

In the folded or collapsed condition of each embodiment of the bin of the present invention, the side panels are folded down inwardly toward each other and lie flush with no overlapping against the top surface of the deckboard of the base panel and with the side panel bottom and top cleats facing upward and away from the base panel deckboard. The end panels are folded down toward each other and lie flush with no overlapping on top of the side panels with the end panel sheets engaging the outer sides of the side panel bottom and top cleats and with each of the inner vertical end panel cleats adjacent an associated hinged side of the side panel bottom cleat and resting on an associated outer side portion of the base panel deckboard. Thus in its collapsed state the bin provides a compact, nesting, integral unit that is easily stored or shipped and which lends itself nicely for stacking and in respect of which the problem that existed in the prior art of panel members becoming mislaid or lost has been substantially eliminated or minimized.

BRIEF DESCRIPTION OF THE DRAWINGS

A better understanding of the present invention may be had from the following detailed description when read in conjunction with the accompanying drawings wherein.

DETAILED DESCRIPTION

Figure 1:
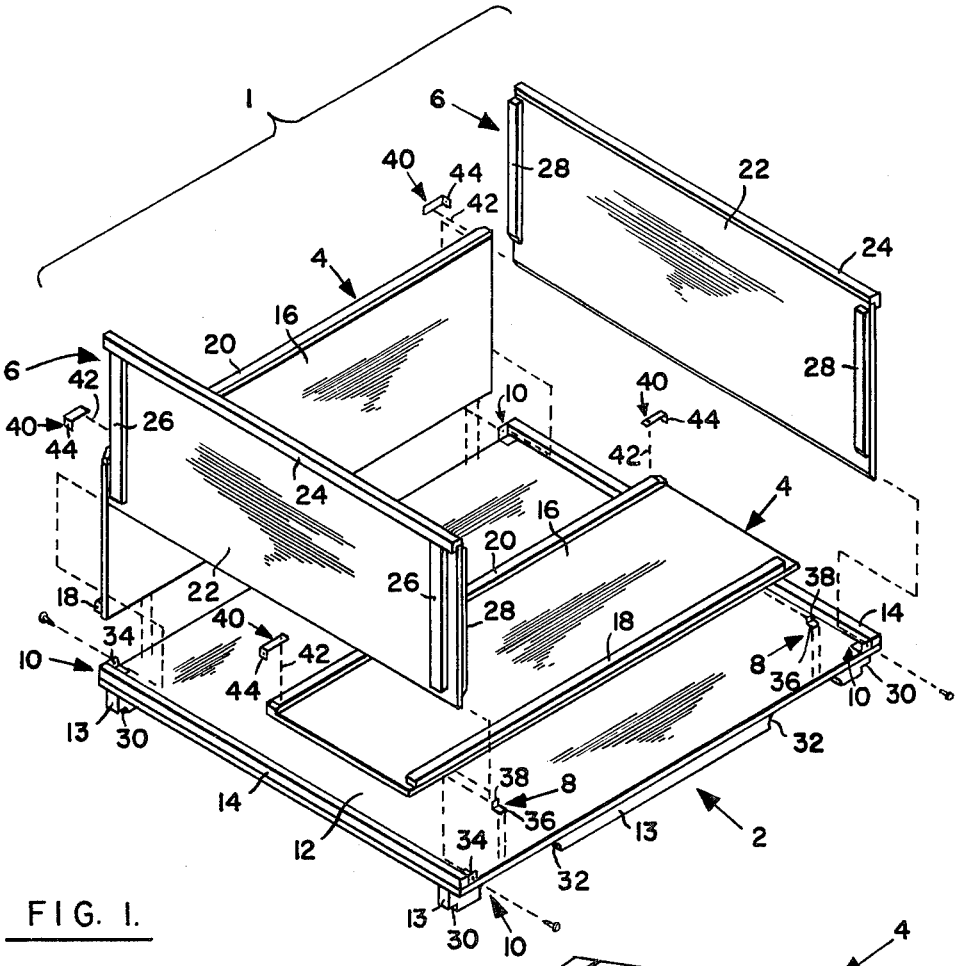
FIG. 1 is an exploded view of a collapsible bin incorporating a first embodiment of the present invention, showing the end panels and one side panel of the bin in their erect positions, and one side panel of the bin folded downwardly against the base panel of the bin.

Referring to the drawings, the bin assembly 1 according to the present invention includes five panel members, a base panel 2, two identical side panels 4 and two identical end panels 6. The side panels 4 are each hinged to the base panel 2 at an associated top side portion of the base panel by a pair of double leafed hinges 8. Each end panel 6 is hinged at the bottom edge thereof to the base panel 2 by a pair of pivot-pin-type hinges 10.

As shown in FIG. 1, the base panel 2 includes a deckboard 12, two or more runners 13 and a pair of cleats 14. Outside runners 13 are attached to the bottom of the base panel 2 near but spaced from the outer side edges thereof by a distance equal to the thickness of the side panels 4 so that runners 13 fit inside a bin stacked below it to prevent sidewise movement between the stacked bins. Cleats 14 are mounted on the upper outer ends of the base panel deckboard 12 and are provided for locking the end panels 6 and the side panels 4 against endwise movement. The base panel cleats 14 extend for the full distance of the width of the ends of the base panel deckboard 12.

Each of the side panels 4 includes a sheet 16, and a side panel bottom cleat 18 is mounted on the outer surface of the bottom portion of each of the side panel sheets 16. The ends of side panel bottom cleat 18 are recessed from the side edges of the side panel sheets 16, as shown particularly in FIGS. 1 and 7. A side panel top cleat 20 is mounted on the top and outer upper surface of the top portion of each of the side panel sheets 16. Desirably, the side panel top cleats 20 are attached to the top edge of the side panel sheets 16 by rabbet and miter joints. By the use of such joints, there is provided a recess in the inner lower sides of the top side panel cleats 20 that receives the top of the side panel sheet 16. The recess forms a cleat shoulder that overhangs the top edge of the side panel sheets 16 to protect the latter against rain and chipping. The ends of the side panel top cleats 20 are flush with the ends of the side panel sheets 16. The outer side and top ends of the side panel top cleats 20 may be bevelled, as shown.

Figure 3:
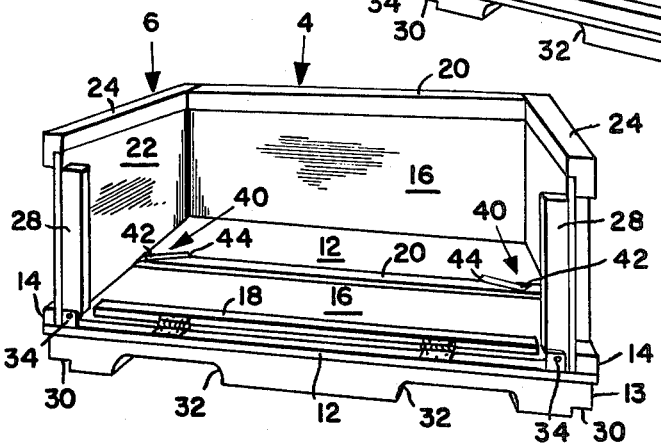
FIG. 3 is a perspective view similar to FIG. 1 showing the end panels and one side panel in their erect positions and one of the side panels folded downwardly against the base panel of the bin.
Figure 4:
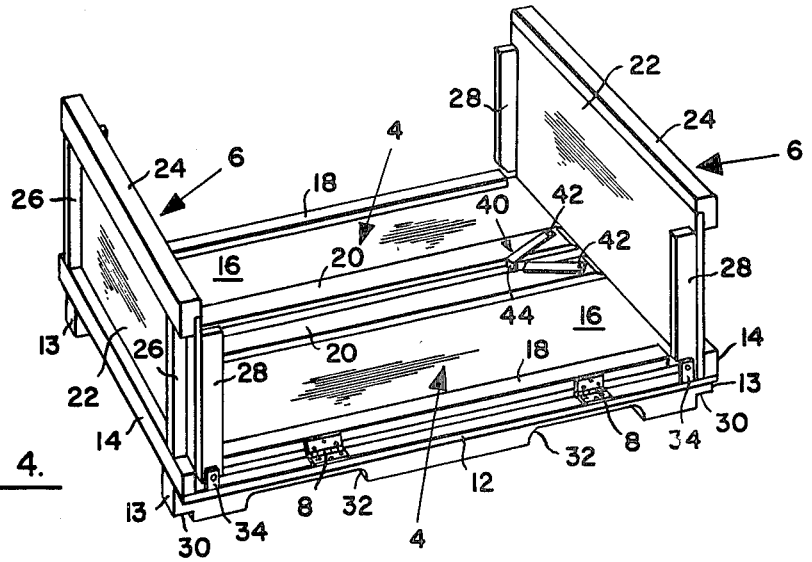
FIG. 4 is another perspective view of the bin showing both end panels in their erect positions and both side panels folded downwardly against the base panel of the bin.
Figure 5:
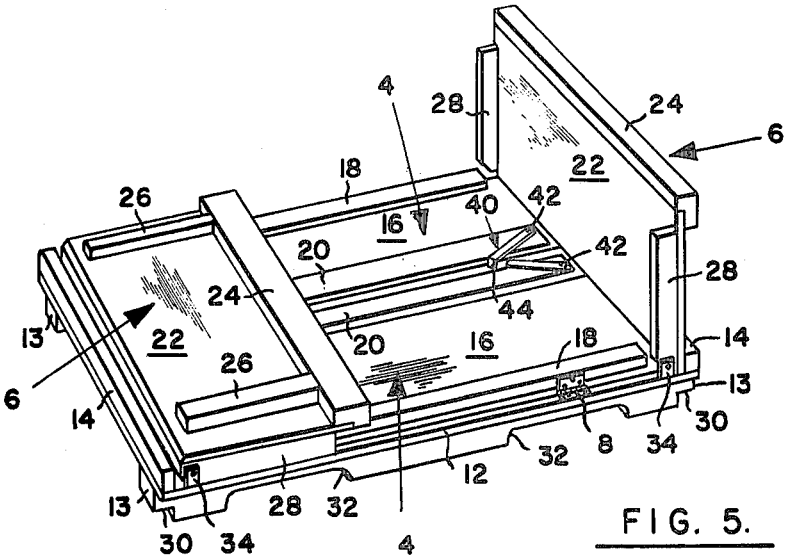
FIG. 5 is a further perspective view of the bin showing both side panels and one of the end panels of the bin folded downwardly against the base panel of the bin, the other end panel being in its erect position.

Each of the end panels 6 includes an end panel sheet 22, and an end panel top cleat 24 that is mounted on the top and outer upper surface of each of the end panel sheets 22 by means of a rabbet and miter joint. As in the case of the side panel cleats 20, the rabbet and miter joints between the top panel cleat 24 and the end panel sheet 22 provide a recess in the inner lower sides of the top end panel cleats 24 that receives the top of the end panel sheet 22, which recess forms a cleat shoulder that overhangs the top edge of the end panel sheets 22 to protect the latter against rain and chipping. The ends of end panel top cleats 24 are flush with the side edges of the end panel sheets 22. A pair of end panel upright posts or stacking cleats 26 are mounted on the outer surface of each of the end panel sheets 22. Each stacking cleat 26 is recessed from an associated side of the end panel 22 by a distance approximately equal to the width of the stacking cleat 26. The top end of each stacking cleat 26 abuts the lower edge of the associated end panel top cleat 24, and the bottom ends of the stacking cleats 26 are recessed from the bottom of the associated end panel sheet 22 by a distance equal to the height of the base panel cleat 14. A pair of vertical, spaced end panel cleats 28 are mounted on the inner surface of the end panel sheets 22 at the side edges of end panel sheets 22. The end panel vertical cleats 28 are recessed from the bottom of end panel sheet 22 by a suitable distance as required for hinge means 10, as seen particularly in FIG. 7. End panel cleats 28 also stop short of the top edges of the end panel sheets 22, as seen particularly in FIGS. 3 and 4. Desirably, the inner bottom edges of the vertical end panel cleats 28 are bevelled.

Notches 30 may be provided in the bottom ends of the runners 13, as illustrated in FIGS. 1–6. The length endwise of the runners 13 of each notch 30 is equal to the thickness of end panel cleats 24. Notches 30 are provided to facilitate stacking of the bins. Notches 32 are provided intermediate the ends of the runners 13 for providing side forklift lifting of the bin.

The members 2, 4 and 6 of the collapsible bin herein described as "panels" may be made of any suitable materials such as wood, plywood, fiber, corrugated paper and/or metal. The base panel deckboard 12, the side panel sheets 16 and the end panel sheets 22 may each be made of a continuous sheet of material as illustrated in the drawings, or if desired, may be made of a plurality of spaced pieces, for example, spaced boards or slats. When the word "panel" is used herein, any of these meanings is applicable. Similarly, the base panel runners 13 and the several base, side and end panel cleats may also be made of any of such materials although for many applications wood or metal is preferred.

Figure 7:
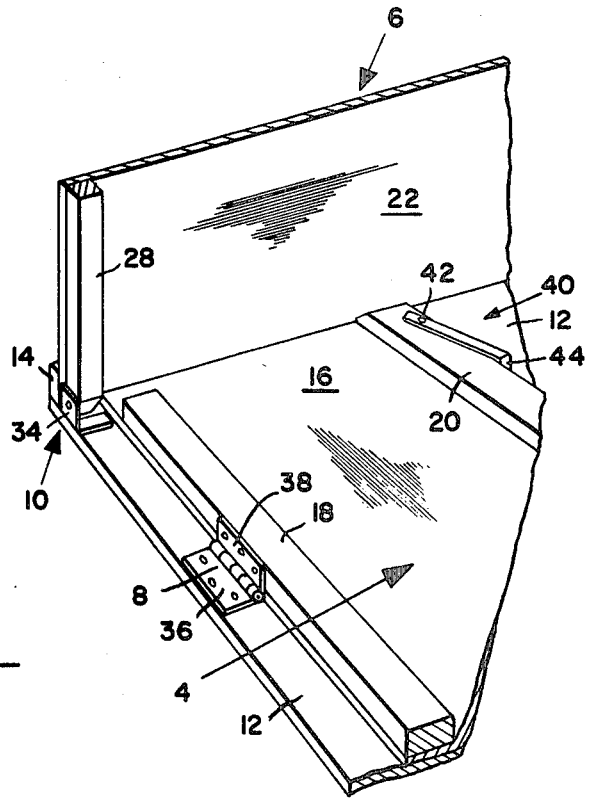
FIG. 7 is a fragmentary perspective view of a lower corner of the bin with the adjacent side panel folded down against the base panel.

The double leaf hinges 8, see FIG. 7, provide side panel hinge means for hingedly connecting the lower edges of the side panels 4 to the top of the base panel deckboard 12 adjacent the sides thereof. Pivot type hinge 10 provides end panel hinge means for hingedly connecting each of the lower side edges of the end panels 6 to the top of the base panel deckboard 12. Each hinge 10, as shown particularly in FIGS. 1 and 7, includes an angle bracket 34 attached to the top surface of base panel deckboard 12 with the vertical member of bracket 34 flush with the edge of the deckboard 12, each angle bracket 34 being spaced from the adjacent base panel cleat 14 by a distance approximating the thickness of the end panel sheet 22. Each angle bracket 34 may be made of any suitable material for example, zinc or cadmium plated steel.

In the assembly of the collapsible bin 1 according to the present invention, each end panel 6 is disposed in an erect position on top of the base panel 2 adjacent an associated base panel cleat 14 with the lower ends of the end panel stacking cleats 26 resting on the top of an associated base panel cleat 14, and with the outer surfaces of the spaced vertical end panel cleats 28 abutting against the inner surfaces of the vertical members of spaced angle brackets 34. Aligned holes are provided in the vertical member of each angle bracket 34 and in the adjacent lower portion of the end panel cleats 28. A hinge pin, for example a machine screw, is inserted through the aligned holes in the angle bracket 34 and into the end panel cleat 28 and is retained in position by suitable means, for example, by a T-nut and bolt. The vertical spacing of the aligned holes in angle brackets 34 and end panel cleats 28 above the top of the base panel deckboard 12 is so selected that when the end panels 6 are folded inwardly over the base panel deckboard 12 to their collapsed positions, they are adapted to lie parallel to and spaced from the base panel deckboard 12 by the thickness of the side panels 4. As seen in the drawings, particularly in FIGS. 1, 5 and 6, the lower outer edges of the end panel sheets 22 may be bevelled in order to avoid contacting the base panel cleats 14 when the end panels 6 are being folded into their collapsed positions. Desirably, the lower inner edges of the end panel cleats 28 are also bevelled to avoid contact with the base panel deckboard 12 when the end panels 6 are folded to their collapsed positions.

With the end panels 6 mounted and disposed in their erect positions, the bin may be collapsed by lowering side panels 4 flat on top of the base panel deckboard 12 with the cleats 18 and 20 facing upwardly, as illustrated in FIGS. 3, 4, 5 and 6, and with the lower edges of lower side panel cleats 18 disposed adjacent to but spaced from an associated side edge of the base panel deckboard 12 by a distance approximating the thickness of the side panels, a distance that also is equal to the width of the leaf 36 of hinge 8. Leaf 36 of each hinge 8 is attached to the base panel deckboard 12 and the other leaf 38 thereof is attached to the lower edge of the side panel cleats 18, the attachment in each case being by screw means, for example. A pair of hinges 8 desirably is provided to mount each side panel 4 to the deckboard 12, as shown.

Each side panel bottom cleat 18 stops short of the side edges of the side panel sheets 16. Hence, when the side panels 4 are raised upwardly about their hinges to their erect positions, the ends of the side panel bottom cleats 18 pass between the lower inboard edges of the end panel cleats 28. The upper ends of the end panel cleats 28 stop short of the upper edges of the end panels. Thus the lower edges of the side panel top cleats 20 are adapted to pass over the upper ends of the end panel cleats 28 as the side panels 4 are moved into their erect positions. Due to the bevelling of the end edges of the side panel top cleats 20, friction with the inside surface of the end panel sheet 22 is minimized as the side panels 4 are moved between their erected and collapsed positions.

Figure 2:
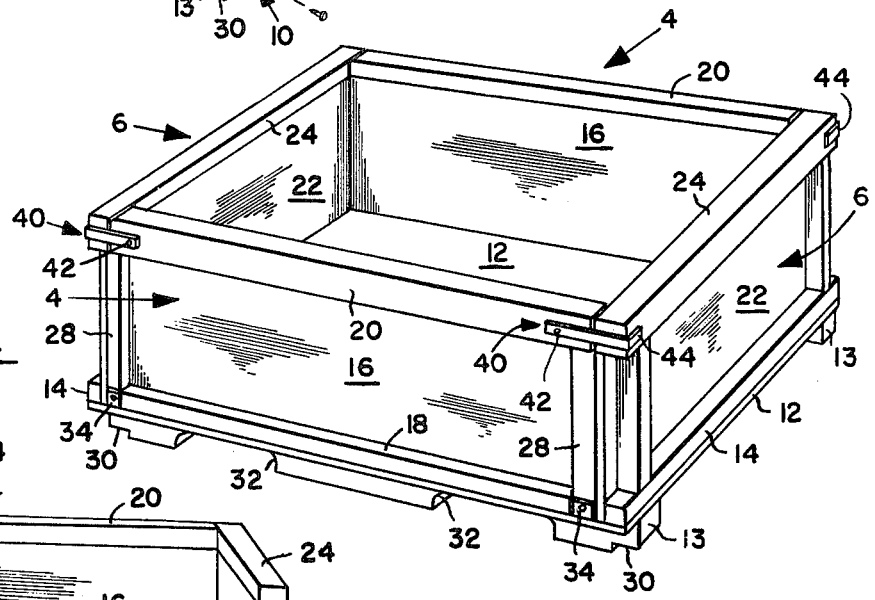
FIG. 2 is a perspective view of a completely erected bin of the type shown in FIG. 1.

With both end panels 6 and both side panels 4 in their erect positions, the bin assembly 1 may be locked in this position by suitable means, for example, locking means comprising four latches 40 that are attached one to each outer end of each of the side panel top cleats 20, as seen particularly in FIGS. 1 and 2. Each latch 40 is mounted on a pivot 42 and includes a hook 44 that is adapted to be raised up and dropped down over the associated end of an end panel top cleat 24 to embrace the latter. The bin 1 thus is locked in its erected state when all four latches have been so raised up and dropped down over an associated end of the end panel top cleats 24.

When it is desired to collapse the erected bin 1, the latches 40 at one side of the bin are first raised upwardly to release the associated side panel 4. The latches 40 are rotated about their pivots 42 until the hook 44 rests on the top of the associated side panel top cleat 20. The side panel 4 may then be folded downwardly flat against the top surface of the base panel deckboard 12, the side panel pivoting about the associated hinges 8. The latches 40 at the other side of the bin are then similarly released to allow the opposite side panel 4 to be folded inwardly and down upon the top surface of the other side of the base panel deckboard 12. Each end panel 6 may then be folded down on top of the folded side panels 4. Contact of the bottom edge of the end panels 22 with the ends of the side panel top cleats 20 is avoided by the bevelling of the outer side edges of the top cleats 20. Desirably, the bottom outer edges of the end panel sheets 22 are bevelled to avoid contact with the base panel cleats 14 as the end panels are moved between their erect and collapsed positions. Additionally, the bevelling of the inner lower edges of the end panel vertical cleats 28 avoids contact of the latter with the base panel deckboard 12 when the end panels are moved between their erected and collapsed positions.

Figure 6:
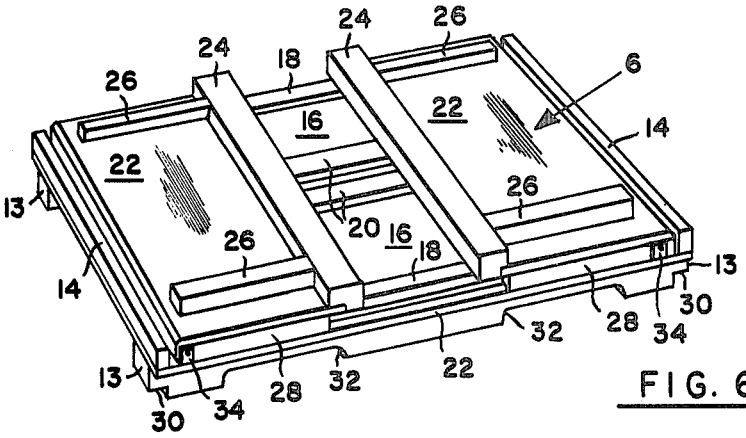
FIG. 6 is a further perspective view showing the bin in its fully folded or collapsed state.

The collapsed bin, as illustrated in FIG. 6, occupies a minimum of space and forms a package that is readily handled for storage when emptied of its contents and for return shipment for further use. Since the collapsed container is a compact, integral unit, the possibility of any of the parts comprising the bin becoming lost in storage or shipment has been eliminated or at least greatly minimized.

The bin according to the present invention further is characterized in that the base panel deckboard 12 provides a skid or pallet which conveniently may be handled by a forklift truck. The notches indicated at 32 in the bottom portion of the base panel runners 12 allow side loading of the bin by forklift truck as well as end loading.

Figure 8:
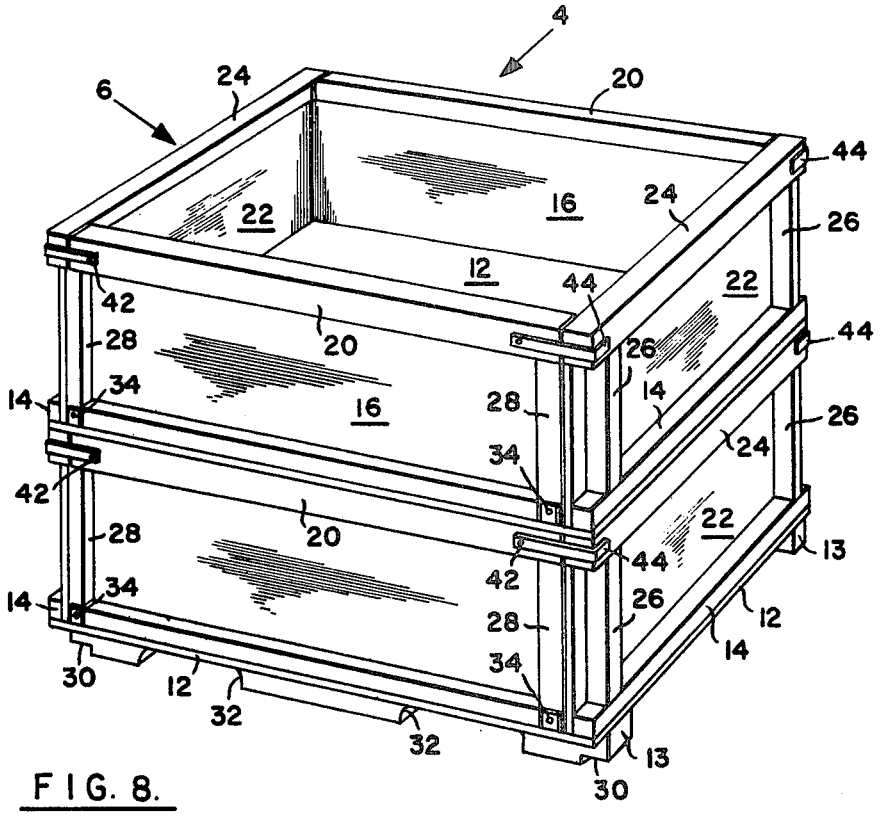
FIG. 8 is a perspective view of two bins according to the present invention, erected and stacked one upon the other.

A further feature of the collapsible bin of the present invention, as illustrated in FIG. 8, is its provision for allowing stacking of bins while minimizing the load placed upon the side walls 4 and the end walls 6 of the lower bins. Notches 30 in the bottom ends of the base panel runners 13 provide vertical shoulders for contacting the inner sides of the end panel top cleats 24 of a lower bin to prevent endwise sliding between stacked bins. The lower outside edges of the outside runners 13 extend for a short distance into the lower bin and contact the inner sides of the side panel top cleats 20 to prevent sidewise movement between stacked bins. Thus, when stacked, the bins nest on top of each other in a stable condition.

When stacked, it is noted that the load of an upper bin is directly carried by the runners 13 of the upper bin resting on the top surface of the end panel top cleats 24 of the lower bin. The load of the upper bin thus is transmitted to the lower bin runners 13 by way of the lower bin stacking cleats 26, base panel cleats 14 and deckboard 12. As a consequence, the load of the upper bin on the side panels and end panels of the lower bin is minimized, the load substantially being carried by the lower bin end panel top cleats 24, stacking cleats 26, deckboard 12 and runners 13.

It is noted that the depth of the notches 30 in the runners 13 is so selected as to be effective to prevent endwise and sidewise movement between stacked bins, but not so great that the runners 13 of an upper bin extend such a distance into a lower bin as to interfere with or crush the contents comprising the load of the lower bin.

Although two bins only are shown in stacked relation in FIG. 8, it will be understood that more than two such bins may be stacked, the number depending only upon the physical size of the bins and the character of the loads contained therein.

Figure 9:
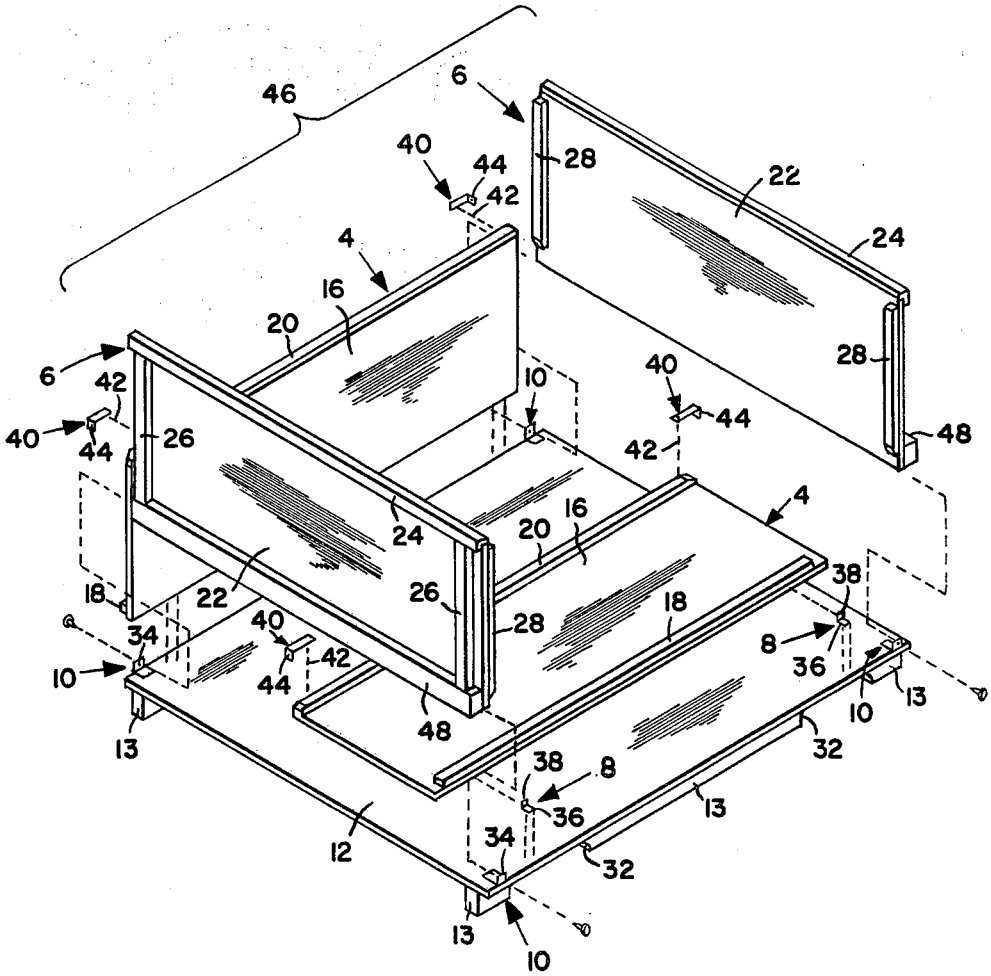
FIG. 9 is an exploded view of a collapsible bin of a second embodiment of the present invention, showing the end panels and one side panel of the bin in their erect positions, and one side panel of the bin folded downwardly against the base panel of the bin.

The collapsible bin embodiment 46 illustrated in FIG. 9 is similar in many respects to the bin embodiment 1 shown in FIG. 1, and for convenience, like parts have been designated by the same reference numerals. The bin embodiment 46 differs from the bin embodiment 1 by the omission of cleats 14 that, as seen in FIG. 1, are mounted on the upper surface of the base panel deckboard 12. Instead, in the bin embodiment 46 shown in FIG. 9, each of the end panels 6 has a bottom cleat 48 mounted on the bottom outer surface of the end panel sheet 22, the ends of the bottom cleats 48 as well as the ends of the top cleats 24 being flush with the side edges of the end panel sheets 22. As in FIG. 1, the top end of each stacking cleat 26 abuts the lower edge of an associated end panel top cleat 24. In FIG. 9, however, the bottom end of each stacking cleat 26 abuts the upper edge of an associated bottom cleat 48.

Mounting the bottom cleats 48 on the end panels instead of cleats 14 on the base panel deckboard eliminates the need for bevelling the lower edges of end panels 22, thereby eliminating a manufacturing operation, and moreover, avoids a possible problem encountered with the bin arrangement of FIG. 1 if shrinkage of the base panel deckboard 12 should occur.

The bin embodiment 46 differs further from that of FIG. 1 in the omission of the notches 30 provided in the bottom ends of the outer runners 13. The notches 30 may be omitted where the prospective user of the bin is not interested in the stacking of bins. It will be understood that notches 30 may be provided in the bottom ends of outer runners 13 in bin 46 where stacking of the bins is desired.

In the assembly of the collapsible bin 46, each end panel 6 is disposed in an erect position on top of the base panel 2 with the lower edge of the associated bottom cleat 48 resting on the top surface of the base panel 2, and with the lower outer surfaces of the spaced vertical end panel cleats 28 abutting the inner surfaces of the vertical members of the spaced angle brackets 34. As in the arrangement of FIG. 1, when the side panels 4 of bin 46 are raised upwardly about hinges 10 to their erect positions the ends of the side panel cleats 18 pass between the two inboard edges of the end panel cleats 28, and the lower edges of the side panel top cleats 20 pass over the upper ends of the end panel cleats 28, providing an open bin very similar in appearance to the bin 1 of FIG. 2. Locking of the end panels 6 and side panels 4 in their erect positions is provided by latches 40.

Collapsing of the bin 46 may be effected in the same manner illustrated and described in connection with FIGS. 3–6 whereby the collapsed bin 46 also may be made to occupy a minimum of space and to form a compact, integral unit that is readily handled both for storage when emptied of its contents and for return shipment for further use, the possibility of losing parts being eliminated or at least greatly minimized.

Thus there has been provided according to the present invention a hinged knock-down returnable self-locking bin that is useful in commercial and industrial applications for packing, shipping or storing objects, which bin is characterized by its simplicity of structure, the ease with which it may be erected for use in singly or in stacked interlocking relation, and the ease with which it may be collapsed so as to occupy a minimum of space for storage and/or for return shipment for further use when emptied of its contents. An important feature of the bin is the freedom from the possibility of loss in panels or other parts of the bin when collapsed or knocked-down for storage or return shipment.

I claim:

1. A hinged knock-down returnable self-locking bin comprising a base panel, first and second side panels, and first and second end panels, said base panel including a deckboard with runners depending therefrom, each of said side panels including a side panel sheet, a side panel bottom cleat mounted on the outer surface of the bottom portion of the side panel sheets and being shorter than the width of the side panel sheets, a side panel top cleat mounted on the outer surface of the top portion of the side panel sheets and having ends that are flush with ends of the side panel sheets, each of said end panels including an end panel sheet, an end panel top cleat mounted on the top outer surface of the end panel sheets, bottom cleat means adapted to be in abutting position between the end panel stacking cleats and the base panel when the bin is erected, a pair of end panel vertically-positioned stacking cleats mounted on the outer surface of the end panel sheets and having top ends which abut the end panel top cleat and having bottom ends which abut the bottom cleat means when the bin is erected, a pair of vertical end panel cleats mounted on the inside surface of the end panel sheets at the side edges of the end panels, side panel hinge means hingedly connecting the side panels to the bottom panel, and end panel hinge means hingedly connecting the end panels to the bottom panel.

2. The hinged bin of claim 1, said bottom cleat means comprising an end panel bottom cleat mounted on the outer surface of the end panel sheets.

3. The hinged bin of claim 1, said bottom cleat means comprising a pair of base panel cleats mounted on the upper surface at the ends of the base panel deckboard.

4. The hinged bin of claim 1, including locking means adapted to connect the top of the side panels to the top of the end panels, whereby the bin may be erected for holding articles and may be collapsed for returning the empty bin.

5. The hinged bin of claim 1, said locking means including a latch pivotally mounted adjacent each end of each of said side panel top cleats, each of said latches being adapted to be rotated over the associated end of said end panel top cleats to lock the side and end panels in upright position.

6. The hinged bin of claim 1, said side panel top cleat having a recess that receives the top of the side panel sheet, with the recess forming a cleat shoulder that overhangs the top edge of the side panel sheet to protect it against rain and chipping.

7. The hinged bin of claim 1, said end panel top cleat having a recess that receives the top of the end panel sheet, with the recess forming a cleat shoulder that overhangs the top edge of the end panel sheet to protect it against rain and chipping.

8. The hinged bin of claim 1, the outer side edges of said side panel top cleats being bevelled for avoiding contact between the end panel sheets and the side panel top cleats when the end panels are being folded over the side panels.

9. The hinged bin of claim 1, the end panel sheets having their bottom outer edges bevelled to avoid contact with the edges of the base panel cleats when the end panels are being folded over the side panels.

10. The hinged bin of claim 1, the ends of the base panel runners being notched to provide vertical shoulders adapted to contact the end panel top cleats of a lower bin, when the bins are stacked, to prevent endwise sliding between stacked bins.

11. The hinged bin of claim 1, said vertical end panel cleats mounted on the inside surface of the end panel sheets having bottom ends with the inside edges being bevelled to avoid contacting the base panel deckboard when the end panel is being folded into collapsed position.

12. The hinged bin of claim 1 wherein the side panel hinge means comprise double leaf hinges, one leaf of said hinges being attached to the bottom edges of said side panels and the other leaf being attached to the deckboard of said base panel adjacent the side edge of said deckboard.

* * * * *